US008191287B2

(12) United States Patent
Winter et al.

(10) Patent No.: US 8,191,287 B2
(45) Date of Patent: Jun. 5, 2012

(54) ELASTOMERIC PLOW EDGE

(75) Inventors: Kent Winter, Willoughby, OH (US); Phil Prucey, Willoughby, OH (US)

(73) Assignee: Winter Equipment Company, Willoughby, OH (US)

( * ) Notice: Subject to any disclaimer, the term of this patent is extended or adjusted under 35 U.S.C. 154(b) by 185 days.

(21) Appl. No.: 12/724,464

(22) Filed: Mar. 16, 2010

(65) Prior Publication Data

US 2011/0225854 A1 Sep. 22, 2011

(51) Int. Cl.
*E02F 3/00* (2006.01)

(52) U.S. Cl. ..... 37/266

(58) Field of Classification Search ..... 37/266, 37/270, 271, 232, 233, 446, 460, 465, 231; 172/701.3, 719, 747, 811, 816
See application file for complete search history.

(56) References Cited

U.S. PATENT DOCUMENTS

| | | | |
|---|---|---|---|
| 2,061,585 | A | 11/1936 | Meyer |
| 3,465,456 | A | 9/1969 | Meyer |
| 3,477,149 | A | 11/1969 | Wagner |
| 4,050,170 | A | 9/1977 | Proehl |
| 4,250,760 | A | 2/1981 | Garries |
| 4,346,528 | A | 8/1982 | Shwayder |
| 4,450,635 | A | 5/1984 | Shwayder |
| 4,476,642 | A | 10/1984 | Hemphill |
| 4,590,694 | A | 5/1986 | Block |
| 4,607,781 | A | 8/1986 | Shwayder |
| 4,711,503 | A | 12/1987 | Berchem |
| 4,756,102 | A | 7/1988 | Chapman |
| 4,833,801 | A | 5/1989 | Winter |
| 4,899,472 | A | 2/1990 | Winter |
| 5,081,774 | A | 1/1992 | Kuwano |
| 5,096,772 | A | 3/1992 | Snyder |
| 5,210,965 | A | 5/1993 | Funk |
| 5,375,350 | A | 12/1994 | Maybon |
| 5,471,770 | A | 12/1995 | Ferreira |
| 5,611,157 | A | 3/1997 | Ferreira |
| 5,636,458 | A | 6/1997 | Drake |
| 5,647,448 | A | 7/1997 | Skaggs |
| 5,724,755 | A | 3/1998 | Weagley |
| 5,743,033 | A | 4/1998 | Gegel |
| 5,822,893 | A | 10/1998 | Ostermeyer |
| 5,946,830 | A | 9/1999 | Ostermeyer |
| 6,240,662 | B1 | 6/2001 | Borowiak |
| 6,256,910 | B1 | 7/2001 | Grozde |
| 6,258,193 | B1 | 7/2001 | Coffin |
| 6,269,559 | B1 | 8/2001 | Edwards |
| 6,315,056 | B1 | 11/2001 | Ransom et al. |
| 6,457,269 | B1 | 10/2002 | Esterhuyse |
| 6,560,904 | B2 | 5/2003 | Guggino |
| 6,571,493 | B2 | 6/2003 | Amano et al. |
| 6,751,894 | B2 * | 6/2004 | Verseef ..... 37/266 |
| 6,832,443 | B1 | 12/2004 | Piel et al. |

(Continued)

*Primary Examiner* — Robert Pezzuto
(74) *Attorney, Agent, or Firm* — Fay Sharpe LLP; Karl W. Hauber

(57) ABSTRACT

A plow edge having improved durability and performance is provided which can comprise an elastomeric material, for example, a styrene elastomeric material. The present disclosure provides a plow blade edge system for mounting to a mold board of a plow comprising an adapter blade including a bottom edge having a carbide insert along a portion of the bottom edge; an elastomeric blade selectively reversible to present first and second edges; a clamp bar wherein the clamp bar is mounted to the adapter blade with the elastomeric blade secured therebetween; and, the elastomeric blade secured selectively in a first position or a second position.

30 Claims, 10 Drawing Sheets

U.S. PATENT DOCUMENTS

| | | | | |
|---|---|---|---|---|
| 6,854,808 | B2 | 2/2005 | Kostecki | |
| 6,922,924 | B2 | 8/2005 | Jones et al. | |
| 7,143,531 | B2 | 12/2006 | Micozzi | |
| 7,159,344 | B2 | 1/2007 | Karhi | |
| 7,347,014 | B1 | 3/2008 | Fiandach | |
| 7,665,234 | B2 * | 2/2010 | Diehl et al. | 37/266 |
| 7,730,641 | B2 * | 6/2010 | Ruuska | 37/232 |
| 2003/0182824 | A1 | 10/2003 | Coffin et al. | |
| 2003/0221338 | A1 | 12/2003 | Verseef | |
| 2004/0006898 | A1 | 1/2004 | Koch et al. | |
| 2006/0218822 | A1 | 10/2006 | Hosmer | |
| 2007/0062072 | A1 | 3/2007 | Schmeichel | |
| 2007/0256334 | A1 | 11/2007 | Schmeichel | |
| 2008/0263907 | A1 | 10/2008 | Winter | |

* cited by examiner

ELASTOMERIC PLOW EDGE

BACKGROUND

The present disclosure relates generally to devices for improving the durability, performance, and operation of plow blades. Specifically, the present disclosure provides an improved plow blade edge, for example, snow plow edge and method for replacing.

Rough terrain and cold weather conditions have caused problems for snow plow blades for as long as there have been snow plows. Although many modifications and alternative designs have been made to snow plow blades in attempts to improve the life, durability, and performance of snow plow blades, in particular, the life, durability and performance of snow plow blade edges, most of these modifications and alterations did not provide sufficient durability and ride improving capabilities to deal with, among other things, the rough terrain and cold weather that snow plow blades are typically exposed to. Typically, prior art snow plow edges are metallic, for example, steel, and are excessively damaged or even destroyed due to wear from contact between the plow edge and the terrain and corrosion (which is exacerbated by road salt). Such prior art blade edges must frequently be repaired or replaced.

In addition, rigid prior art snow plow blade edges typically can damage the surface over which they are moved, for example, asphalt or concrete. Due to their rigidity, snow plow blade edges typically transmit loads, for example, shock loads to the vehicle, and vehicle mounting components to which the plow blade is attached. The aforementioned shock loads, in turn, are then transmitted to the driver of the vehicle. These loads can damage or incapacitate the vehicle or vehicle mounting components. In addition, the shock loads exacerbate a driver's dissatisfaction with the task of plowing. Furthermore, metallic prior art blade edges are not effective in plowing fluid-like or finely granulated media, for example, slush, water, and other fluids or powders. There is a need in the art to provide a snow plow blade edge which avoids these limitations of prior art plow blade edges, in particular, limitations in prior art snow plow blade edges.

The present disclosure describes a resilient construction material and method of mounting which can be used to provide new plow blade edges or replace worn plow blade edges, in particular, snow-plow blade edges or other surface plows, that overcome many of the limitations of the prior art.

SUMMARY

One aspect of the present disclosure provides for a plow blade edge system which can be mounted to a mold board of a plow. The plow blade system includes an adapter blade including a bottom edge having a carbide insert along a portion of the bottom edge. The blade system further includes an elastomeric blade selectively reversible to present first and second edges. Furthermore, the blade system includes a clamp bar wherein the clamp bar is mounted to the adapter blade with the elastomeric blade therebetween.

Another aspect of the present disclosure provides a method for replacing an existing plow edge with an elastomeric plow edge. The method comprises mounting at least one adapter blade to a mold board; attaching at least one planar elastomeric plow edge segment to the at least one adapter blade; and, connecting at least one clamp bar to the at least one adapter blade wherein the at least one planar elastomeric plow edge segment is secured between the at least one adapter blade and the at least one clamp bar in a first position.

Another aspect of the present disclosure provides for a plow blade edge kit for mounting to a mold board of a plow. The edge kit comprises an adapter blade including mounting holes for mounting to a mold board. The adapter blade further includes mounting bushings. The edge kit further provides for a rubber plow blade including holes for placing on the mounting bushings selectively in a first position or a second position, a clamp bar having holes aligned with the mounting bushings, and a plurality of fasteners passing through the mounting bushings for securing the clamp bar to the adapter bar whereby the rubber plow blade is mounted between the clamp bar and the adapter blade.

BRIEF DESCRIPTION OF THE DRAWINGS

The subject matter which is regarded as the disclosure is particularly pointed out and distinctly claimed in the concluding portion of the specification. The present disclosure, however, both as to organization and method of practice, together with further objects and advantages thereof, may best be understood by reference to the following detailed descriptions of the preferred embodiments and the accompanying drawings in which:

DETAILED DESCRIPTION

Figure 1:
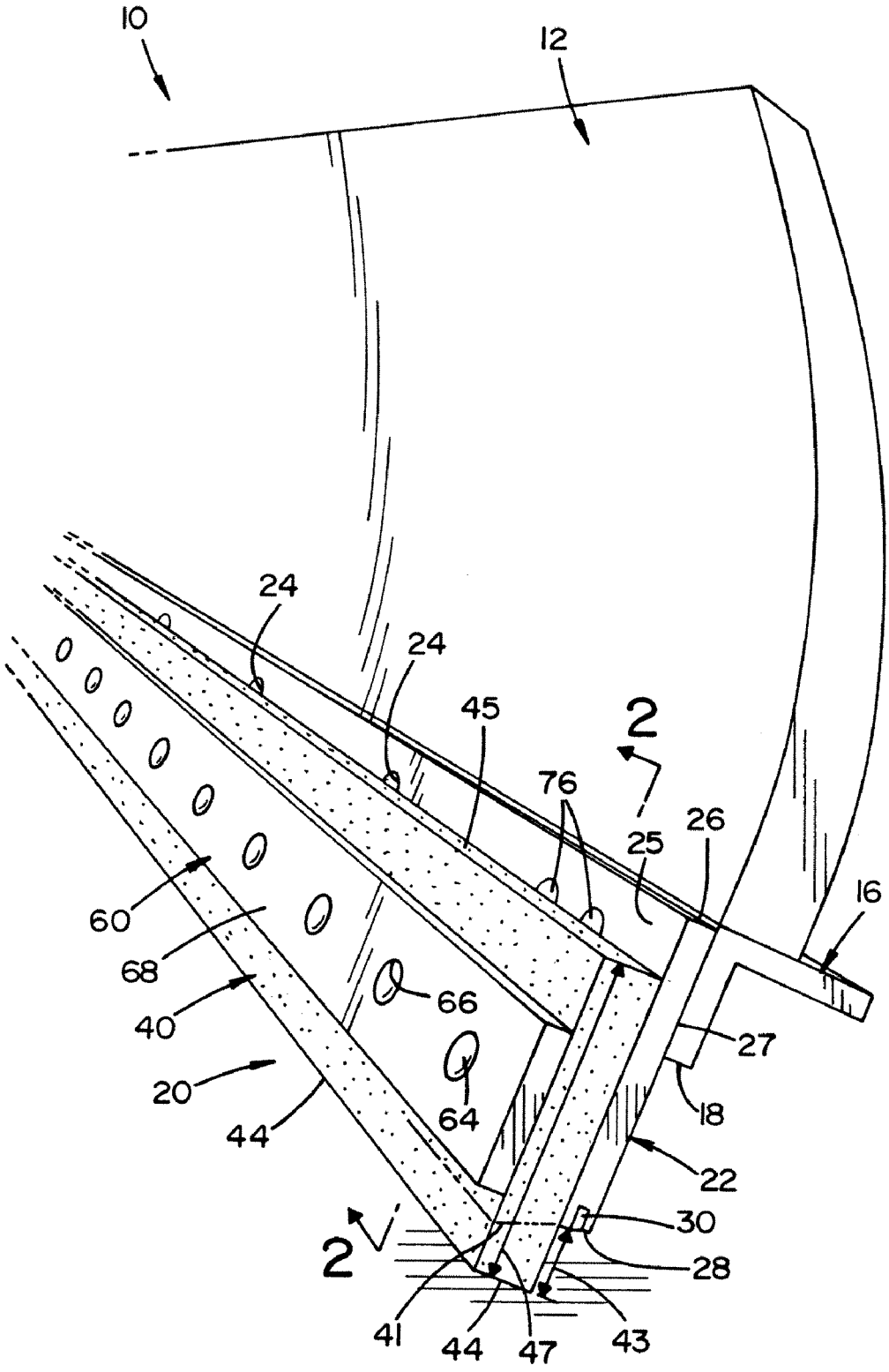
FIG. 1 is a perspective view of a plow blade according to one aspect of the present disclosure.

FIG. 1 is a perspective view of a plow assembly 10 displaying one aspect of the present disclosure. The plow assembly 10 includes a plow body 12 which is typically of hemispherical and funnel shaped steel construction for deflecting snow or other media. Plow assembly 10 is typically attached to a vehicle (not shown) by means of an appropriate frame or housing (also not shown). The vehicle may be any vehicle ranging from a standard car or pickup truck to a sand and salt-carrying dump truck to a road grader having a belly-mounted blade, to huge earth-moving or snow-moving plows. The means of attaching the plow body 12 to a vehicle may also typically include some form of hydraulic mechanism for positioning plow body 12 as desired, as is typical in the art. The plow assembly 10 may also include one or more reinforcing members to provide strength and rigidity to plow body 12. Reinforcing members are typically standard structural angles which are attached to the back of plow body 12, for example, by means of welding.

The plow assembly 10 can include at least one replaceable (or non-replaceable) plow edge or mold board 16 mounted to the base of plow body 12 where edge 18 will contact the plowed surface, for example, a road surface. Mold board 16 is usually replaceable since its rigid construction is typically prone to damage due to abrasive contact with the surface being plowed or to obstacles, for example, pot holes, sewer covers, trees, mail boxes, and the like, encountered while plowing. Mold board 16 is typically of metallic construction, for example, steel construction, and is mounted to body 12 by a plurality of mechanical fasteners, for example, a plurality of nuts, bolts, and washers (not shown). Mold board 16 typically includes slotted perforations to allow for adjustment of the mounting of the mold board 16 during initial installation or for adjustment of the mounting of the mold board 16 after use and wear.

Figure 2:
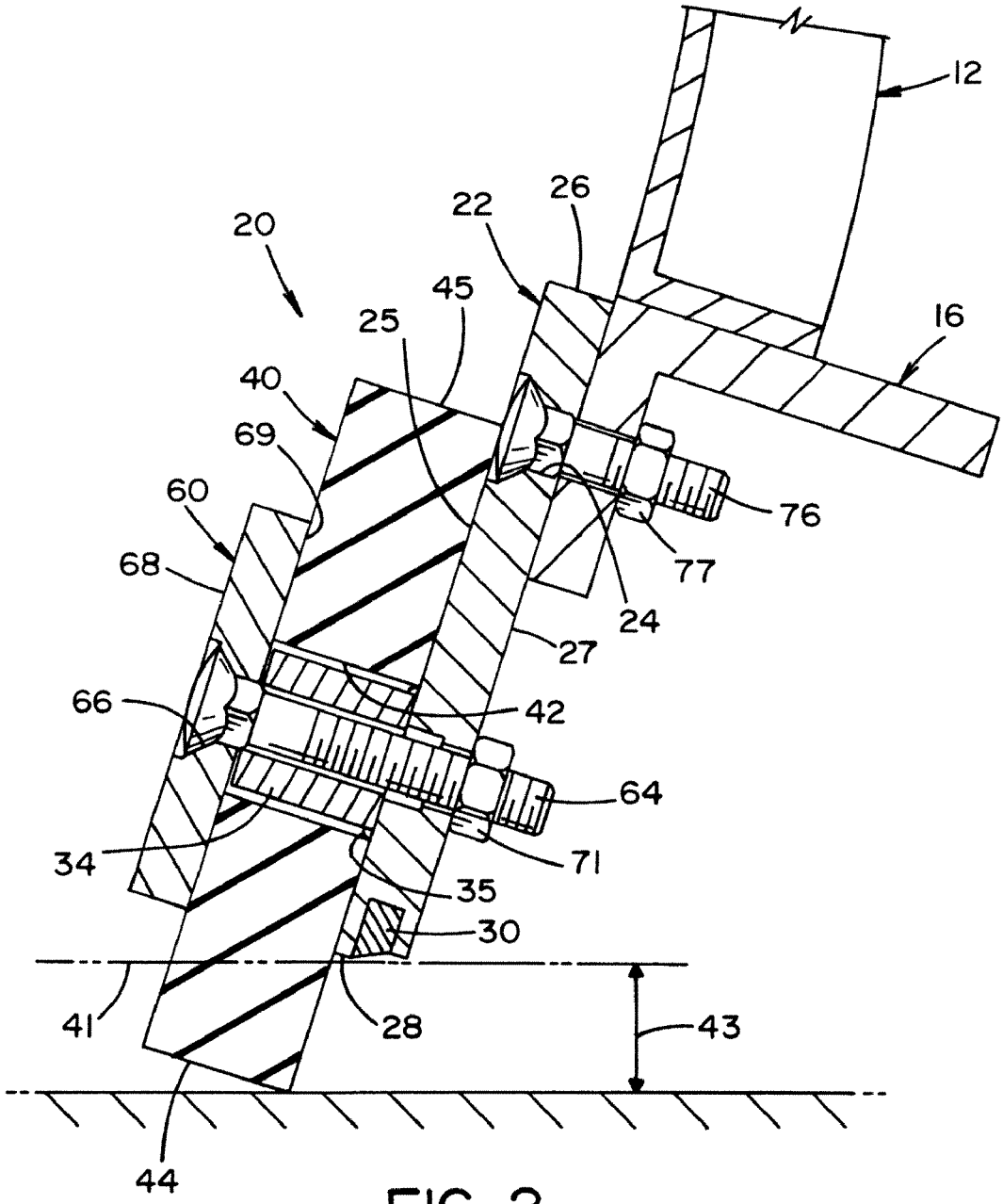
FIG. 2 is a cross sectional view taken along section lines 2-2 in FIG. 1 according to a first mounting arrangement.
Figure 3:
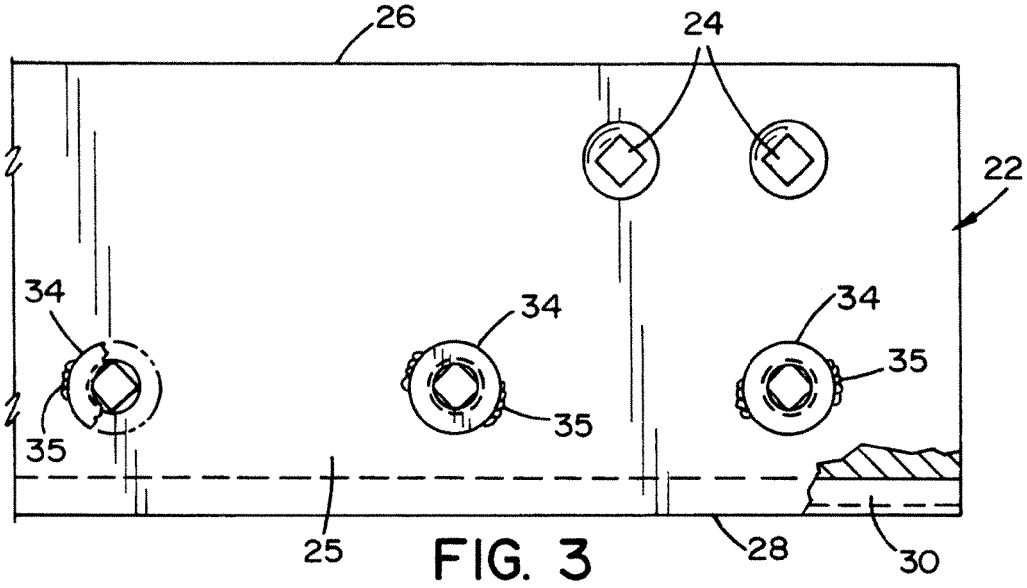
FIG. 3 is a plan view of an adapter blade.

Referring now to FIGS. 1-5, a plow blade edge system 20 is therein displayed. Namely, an adapter blade 22 can be mounted to the mold board 16 of the plow body 12. The mold board 16 can be in a damaged or used condition. FIG. 3 illustrates a detailed plan view of adapter blade 22 according to one aspect of the present disclosure. The adapter blade 22 includes mounting holes 24 aligned along a top edge 26 for securing to the mold board 16. The adapter blade 22 can be from about ¼ inch thick to about 1¼ inch thick and can be made from steel or similar materials. A bottom edge 28 along the adapter blade 22 can include high grade imbedded carbide inserts 30 along at least a portion thereof. To be described in more detail hereinafter, as a rubber blade 40 wears, or is damaged, the adapter blade 22, specifically the carbide inserts 30 along the bottom edge 28, act as a backup to resist wear until the rubber blade 40 can be flipped or replaced. It is to be appreciated that the adapter blade 22 can turn a damaged mold board 16 into a solid mounting surface for the rubber blade 40 or to protect a new mold board 16. In addition, the adapter blade 22 includes a series of bushings 34 aligned proximal to the bottom edge 28. The bushings 34 can be welded 35 to the front face 25 of the adapter blade 22. The bushings 34 provide a mounting arrangement for the rubber or elastomeric plow blade or edge segments 40. The bushings 34 provide a stable mounting platform that holds the plow edge segment 40 in a fixed position for ease of attachment between the adapter blade 22 and a clamp bar 60.

The dimensions of adapter blade 22 will vary depending upon the size of plow body 12 used, for example, the length of blade 22 is limitless, but reinforcing blade 22 typically will have a length from about 3 to about 12 feet. The width or height of blade 22 can be between about 3.0 to about 12.0 inches. For some exemplary embodiments, the length of individual segments of the adapter blade 22 can be 3, 4, 5, and/or 6 feet. In this manner, any combination of two, or three, blade segments can be combined to extend across plow blade 12 having a length of 6, 7, 8, 9, 10, 11 or 12 feet.

Figure 4:
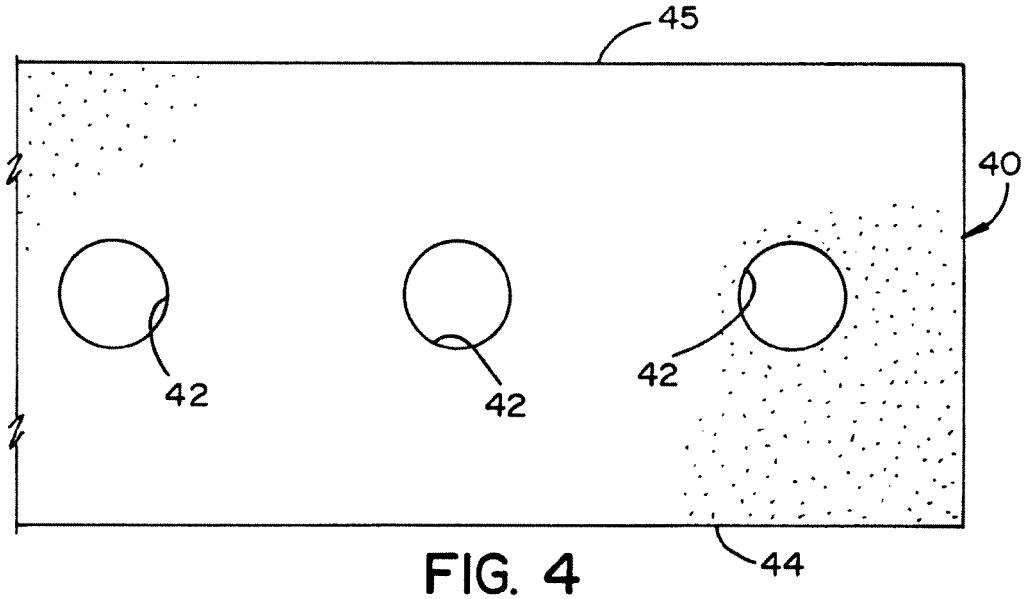
FIG. 4 is a plan view of an elastomeric blade.
Figure 5:
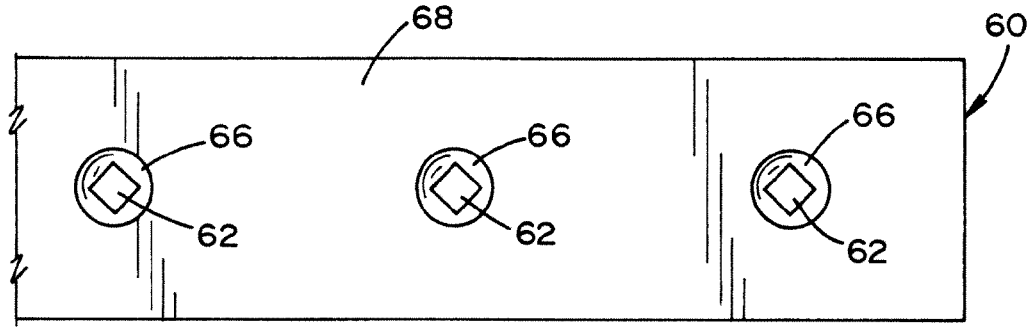
FIG. 5 is a plan view of a clamp bar.

Referring now to FIG. 2, there is shown, plow edge segments mounted to the adapter blade 22, a planar elastomeric plow blade member 40 (FIG. 4). The elastomeric plow edge segment(s) 40 can comprise styrene butadiene rubber (SBR), polyurethane, polyethylene, polystyrene, and rubber. The elastomeric plow edge segment 40 can be pre-drilled including apertures 42 aligned with the bushings 34 of the adapter blade 22. The elastomeric plow edge segment 40 includes two mounting positions such that when first installed in a first position, a first edge 44 is presented to the road surface below. After the first edge 44 has worn to wear line 41, the elastomeric plow edge segment 40 can be dismounted from the plow blade edge system 20, reversed, and remounted such that the elastomeric plow edge segment 40 now is in a second position which presents a second edge 45 to the road surface below. Although not shown, it is to be appreciated that the second edge 45 can wear to a second wear line. Each wear line can be up to about 25% of the overall width or height of edge segment 40. More particularly, the distance 43 from the initial edge 44 to wear line 41 can be about 25% of the overall initial width 47 of plow edge segment 40. In this manner, the overall wear of edge segment 40 can be up to about 50% of the initial width. In one embodiment, the overall wear (i.e. width reduction) of edge segment 40 is from about 28% to about 50% after both edges 44, 45 have worn to their respective wear lines. Thus, the elastomeric plow edge segment 40 enables an extended life for improved performance and a decrease in material cost.

It is to be appreciated, that the elastomeric plow edge segment 40 can comprise any variety of heights and a variety of lengths. The dimensions of elastomeric blade 40 will vary depending upon the size of plow body 12 used, for example, the length of plow edge segment 40 is limitless, but edge segment 40 typically will have a length from about 3 feet to about 12 feet. The width or height of blade 40 can be from about 4.0 inches to about 12.0 inches. The thickness of blade 40 can be from about 0.50 inches to about 3.0 inches. Exemplary embodiments include elastomeric plow blade segments 40 of 3, 4, 5, and 6 foot lengths. In this manner, any combination of two, or three, blade segments 40 can be combined to extend across mold board 16 of 6, 7, 8, 9, 10, 11, and 12 foot lengths. The aforementioned lengths of plow edge segments 40 provide ease of handling and ease of mounting to the adapter blade 22. The plow edge segments 40 can be easily handled and mounted by one person. The plow edge segments 40 can be planar or linear in orientation. In this manner the plow edge segments 40 retain a flat and planar orientation for ease of mounting. Elastomeric plow blade members heretofore known, typically comprise segments cut off from a coiled storage means. A coiled configuration presents difficulties in trying to straighten and mount a curled or curved elastomeric plow blade segment.

Figure 6:
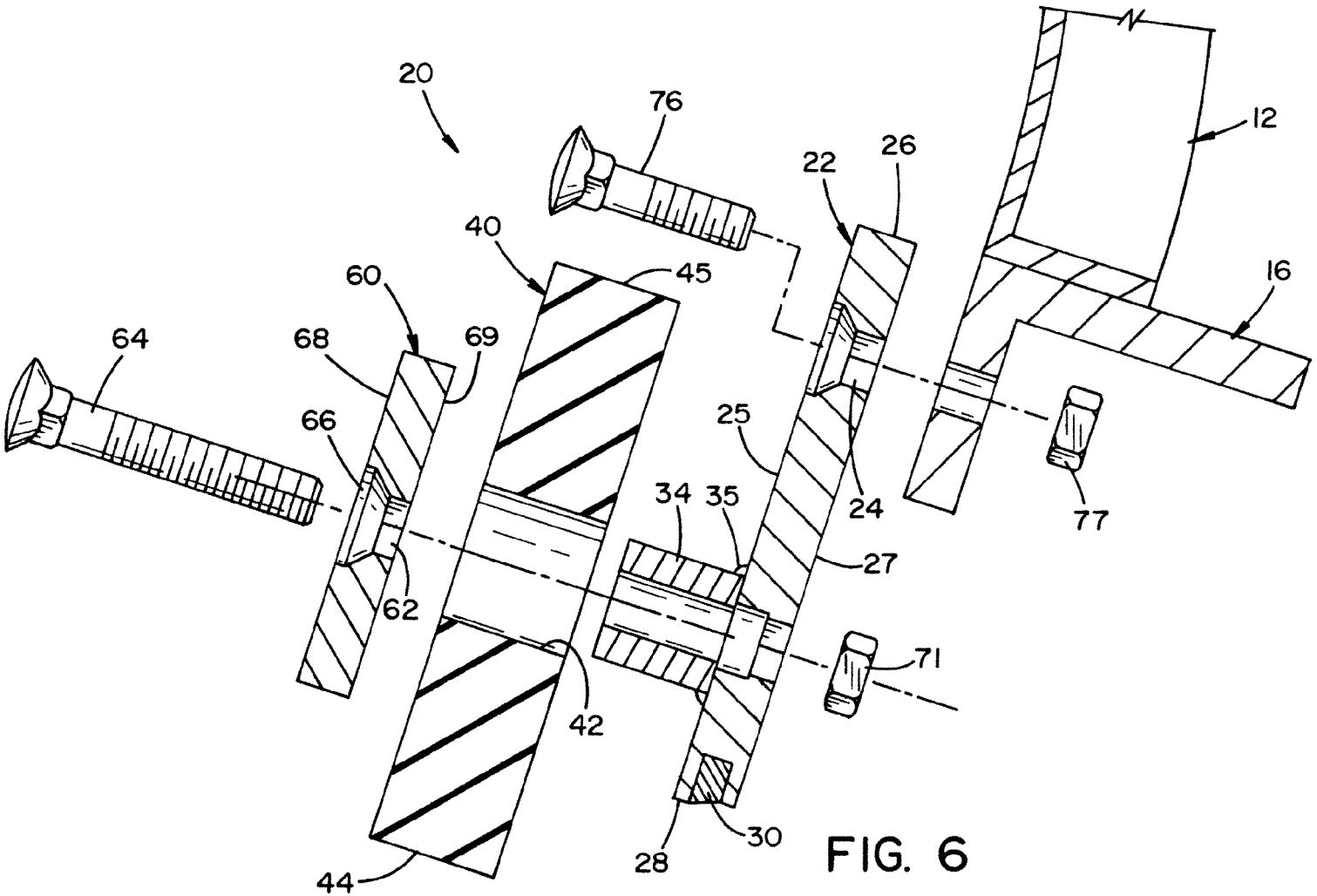
FIG. 6 is an exploded cross sectional view according to the first mounting arrangement.
Figure 7:
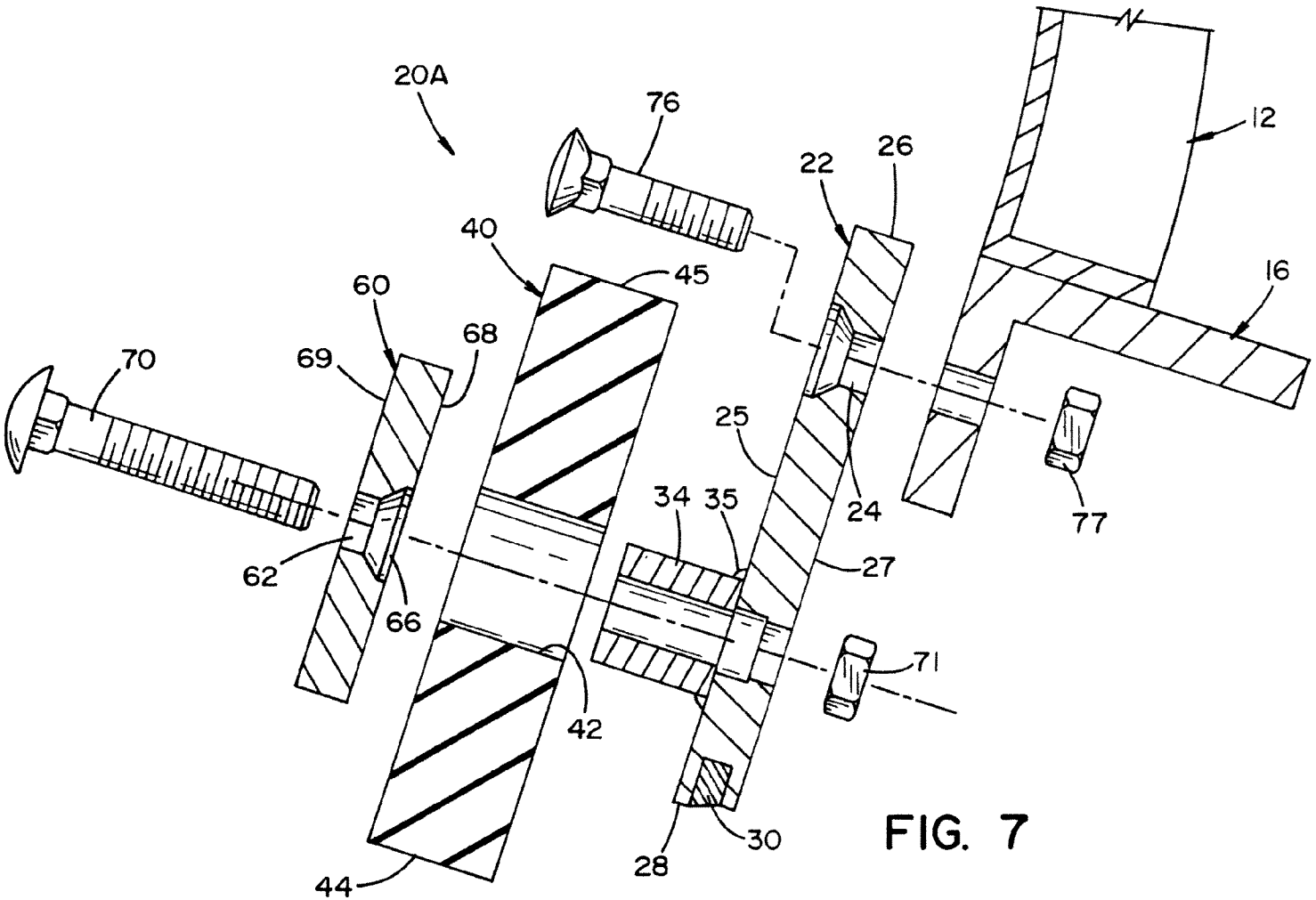
FIG. 7 is an exploded cross sectional view according to a second mounting arrangement.
Figure 8:
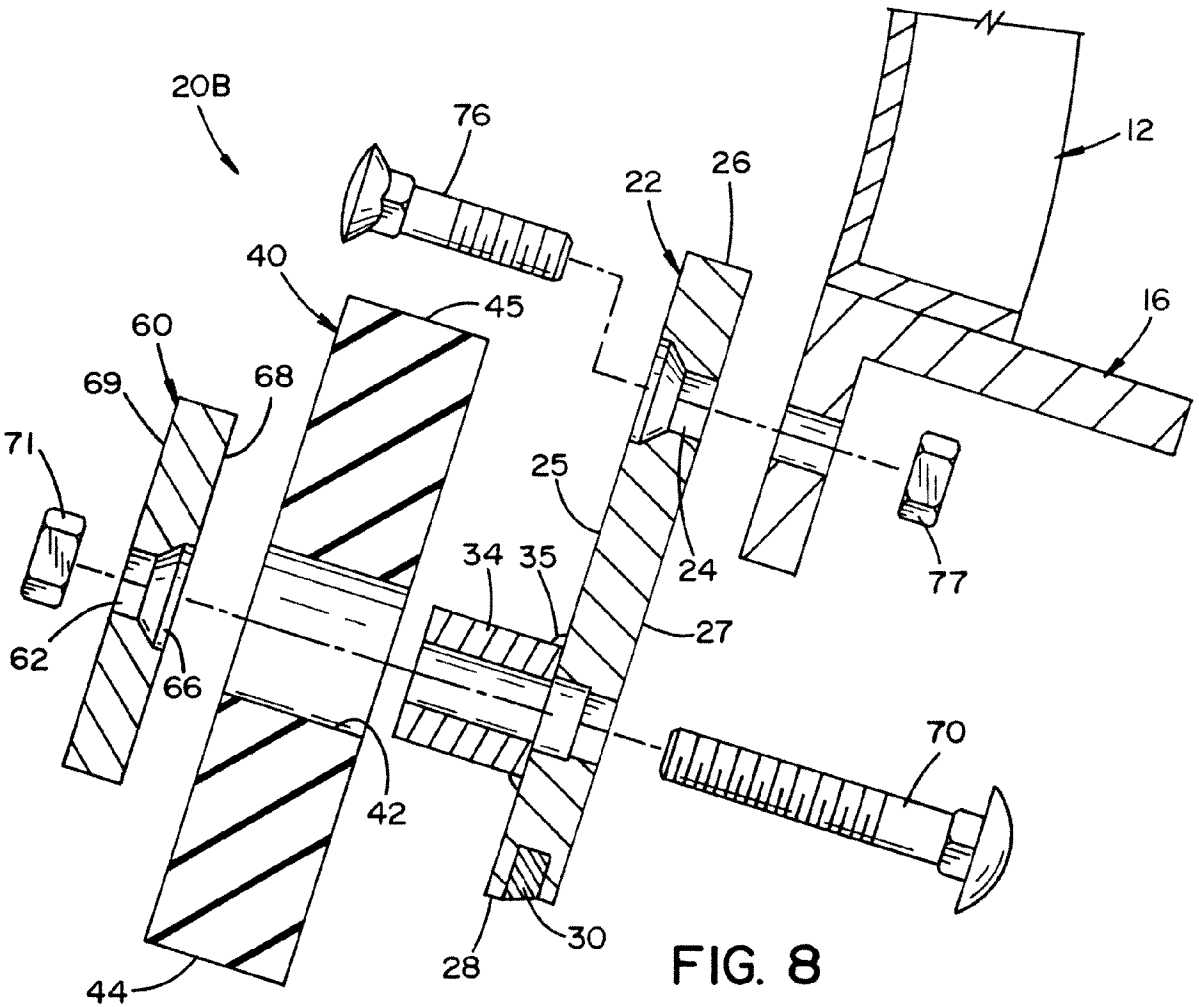
FIG. 8 is an exploded cross sectional view according to a third mounting arrangement.

As shown in FIGS. 6-8, the plow blade edge system 20 can be attached to the plow body 12 in a number of arrangements. A means of mechanical fastening, for example, a plurality of nuts 71 and bolts 64, 70 as shown in FIGS. 6-8 can be provided to fasten the clamp bar 60 (FIG. 5) to the adapter blade 22. The clamp bar 60 includes a series of holes 62 that align with the holes 42 and bushings 34 in the elastomeric plow edge segments and adapter blade segments, respectively. The clamp bar 60 gives support to the elastomeric plow edge segment 40 when plowing and provides a mechanism for keeping the elastomeric plow blade 40 firmly in place. It is to be appreciated that the clamp bar 60 can be reusable and provides a quick and easy method for changing or flipping the elastomeric blade 40 from the first position to the second position. The dimensions of the clamp bar 60 will vary depending upon the size of plow edge used, for example, the length of clamp bar 60 is limitless, but clamp bar 60 typically can have a length from about 3 to about 12 feet. The width or height of clamp bar 60 can be from about 3.0 to about 7.0 inches. The thickness of clamp bar 60 can be from about 0.250 inches to about 1.250 inches. Exemplary lengths include 3, 4, 5, and 6 foot segments. As described above, any number of combinations of these exemplary lengths can be used to accommodate varying sizes of the plow body 12.

Referring to FIG. 6, a first mounting arrangement kit 20 is therein shown and can include a plow bolt 64 extending through a countersunk hole 66 in a first side 68 of the clamp bar 60. As shown, the first side 68 of the clamp bar includes countersunk holes 66 about the mounting holes 62. The plow bolt 64 and nut 71 secures the clamp bar 60 with the adapter blade 22.

Referring to FIG. 7, a second mounting arrangement kit 20A is therein shown and includes a carriage bolt 70 and nut 71, or similar, which can be used for mounting the clamp bar 60 in a second position to the adapter blade 22. In this arrangement, the carriage bolt 70 extends through a square side of hole 62 provided onto a second side 69 of the clamp bar 60.

Referring to FIG. 8, a third mounting arrangement kit 20B is therein shown and includes the carriage bolt 70 and nut 71 which can be used for mounting the clamp bar 60 to the adapter blade 22. In this arrangement, the carriage bolt 70 extends through a rear side 27 of the adapter blade 22 and is secured with nut 71 wherein the clamp bar 60 is in the second position.

The aforementioned plow blade edge system 20, 20A, 20B simplifies mounting thereby reducing maintenance time. The mounting method also eliminates the annoying time consuming adjustments needed with prior art slotted mounting hole designs. The method for replacing an existing plow edge with the elastomeric plow edge system or plow blade edge kit 20, 20A, 20B comprises mounting the adapter blade 22 to the mold board 16, attaching the elastomeric plow edge 40 to the adapter blade 22 in one of a first position or a second position, and then connecting the clamp bar 60 to the adapter blade 22 wherein the elastomeric plow edge 40 is secured between the adapter blade 22 and the clamp bar 60. Once the first edge 44 has worn, the elastomeric plow edge 40 can be reversed by disconnecting the clamp bar 60 from the adapter blade 22, flipping the elastomeric blade 40 from the first position to the second position. The second position exposes the unworn edge or second edge 45 of the elastomeric plow blade 40. Once the elastomeric plow blade 40 has been reversed, the clamp bar 60 can be reconnected to the adapter blade 22. After the second edge 45 has worn, the used plow edge segment 40 can be replaced with a new plow edge segment.

According to one aspect of the present disclosure, plow blade edge kit 20, 20A, 20B can be attached to mold board 16 via adapter blade 22 by means of mechanical fasteners, for example, a plurality of bolts 76 and nuts 77, as shown in FIGS. 6-8. Plow blade edge kit 20, 20A, 20B can include a plurality of slotted mounting holes (not shown) or a plurality of mounting holes 24. The mounting holes 24 will typically have a diameter from about 0.5 inches to about 2.0 inches. Slotted mounting holes will typically have a width from about 0.5 inches to about 3.5 inches and a length from about 2 inches to about 6 inches. The mounting holes 24 and slotted mounting holes are typically equally-spaced along the plow component segments, for example, equally-spaced on about 10-inch, 12-inch, or 14-inch centerlines.

In another embodiment 20C (FIG. 9), an elastomeric plow edge segment 140 can comprise a 'z' shaped, or similar, configuration. One leg 141 of the plow segment 140 can extend below adapter blade 22 and another leg 142 can extend above a clamp or scarifier bar 160. The dimensions of elastomeric blade 140 will vary depending upon the size of plow body 12 used, for example, the length of plow edge segment 140 is limitless, but edge segment 140 typically will have a length from about 3 feet to about 12 feet. The width or height of blade 140 can be from about 4.0 inches to about 12.0 inches. The thickness of blade 140 can be from about 0.50 inches to about 3.0 inches. Exemplary embodiments include elastomeric plow blade segments 140 of 3, 4, 5, and 6 foot lengths. In this manner, any combination of two, or three, blade segments 140 can be combined to extend across mold board 16 of 6, 7, 8, 9, 10, 11, and 12 foot lengths. The aforementioned lengths of plow edge segments 140 provide ease of handling and ease of mounting to the adapter blade 22. The plow edge segments 140 can be easily handled and mounted by one person. The plow edge segments 140 can be stacked, and staggered, one upon the other in a storage orientation. In this manner, the mounting faces of the plow edge segments 140 retain a generally planar orientation for ease of mounting.

A means of mechanical fastening, for example, similar to FIGS. 6-8 can be provided to fasten a scarifier bar 160 (FIG. 9) to the adapter blade 22. The scarifier bar 160 includes a series of holes 162 that align with the holes and bushings in the elastomeric plow edge segments 40, 140 and adapter blade segments, respectively. The scarifier bar 160 gives support to the elastomeric plow edge segment 40, 140 when plowing and provides a mechanism for keeping the elastomeric plow blade 40, 140 firmly in place. It is to be appreciated that the scarifier bar 160 can be turned or flipped over which provides a quick and easy method for changing or flipping the elastomeric blade 40, 140 from a first position to a second position, and also providing another mounting position for bar 160. The dimensions of scarifier bar 160 will vary depending upon the size of plow edge used, for example, the length of scarifier bar 160 is limitless, but scarifier bar 160 typically can have a length from about 3 to about 12 feet. The width or height of scarifier bar 160 can be from about 3.0 to about 7.0 inches. The thickness of scarifier bar 160 can be from about 0.250 inches to about 1.250 inches. Exemplary lengths include 3, 4, 5, and 6 foot segments. As described above, any number of combinations of these exemplary lengths can be used to accommodate varying sizes of the plow body 12.

Figure 9:
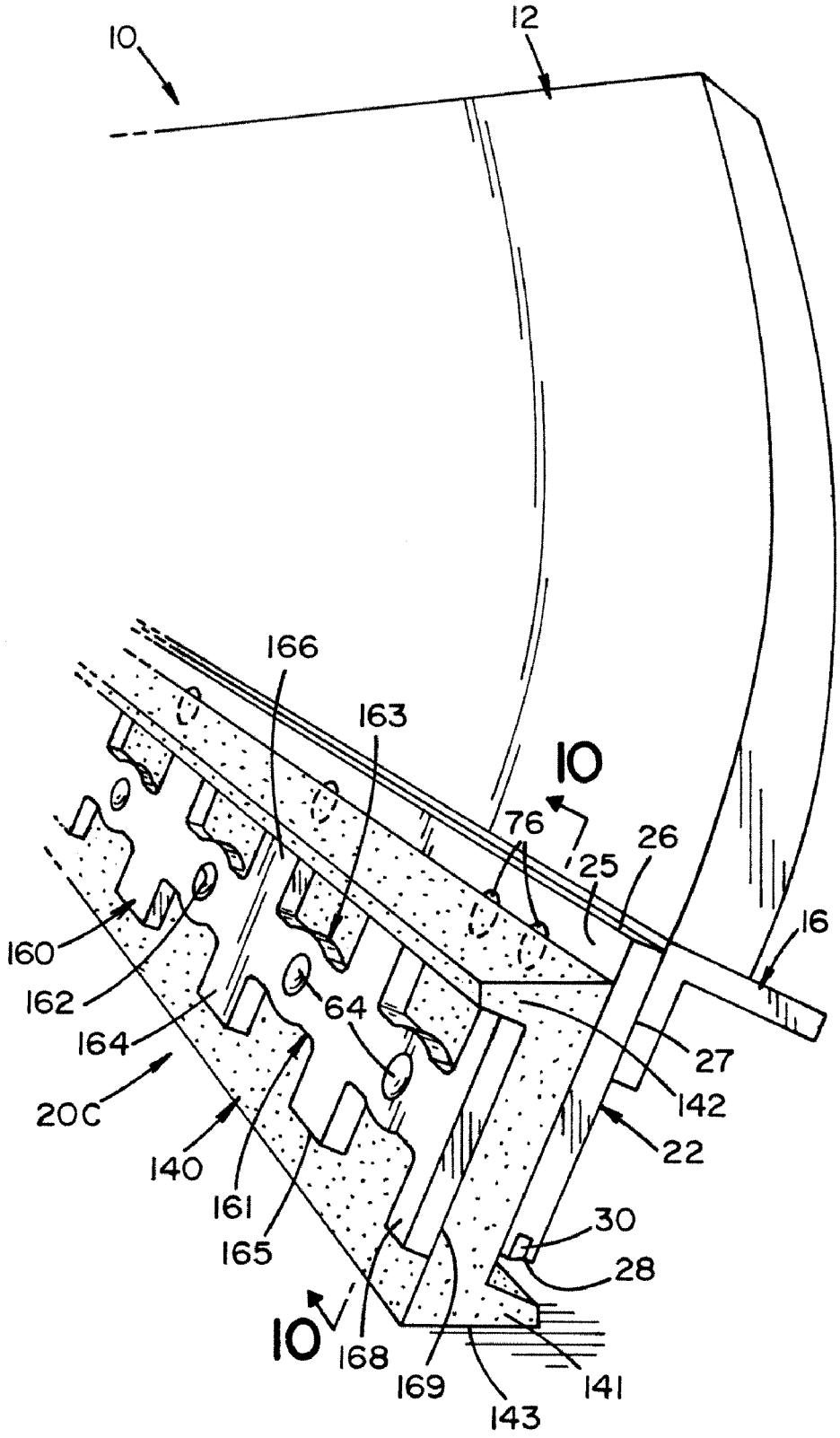
FIG. 9 is a perspective view of a plow blade according to a second embodiment of the present disclosure.
Figure 10:
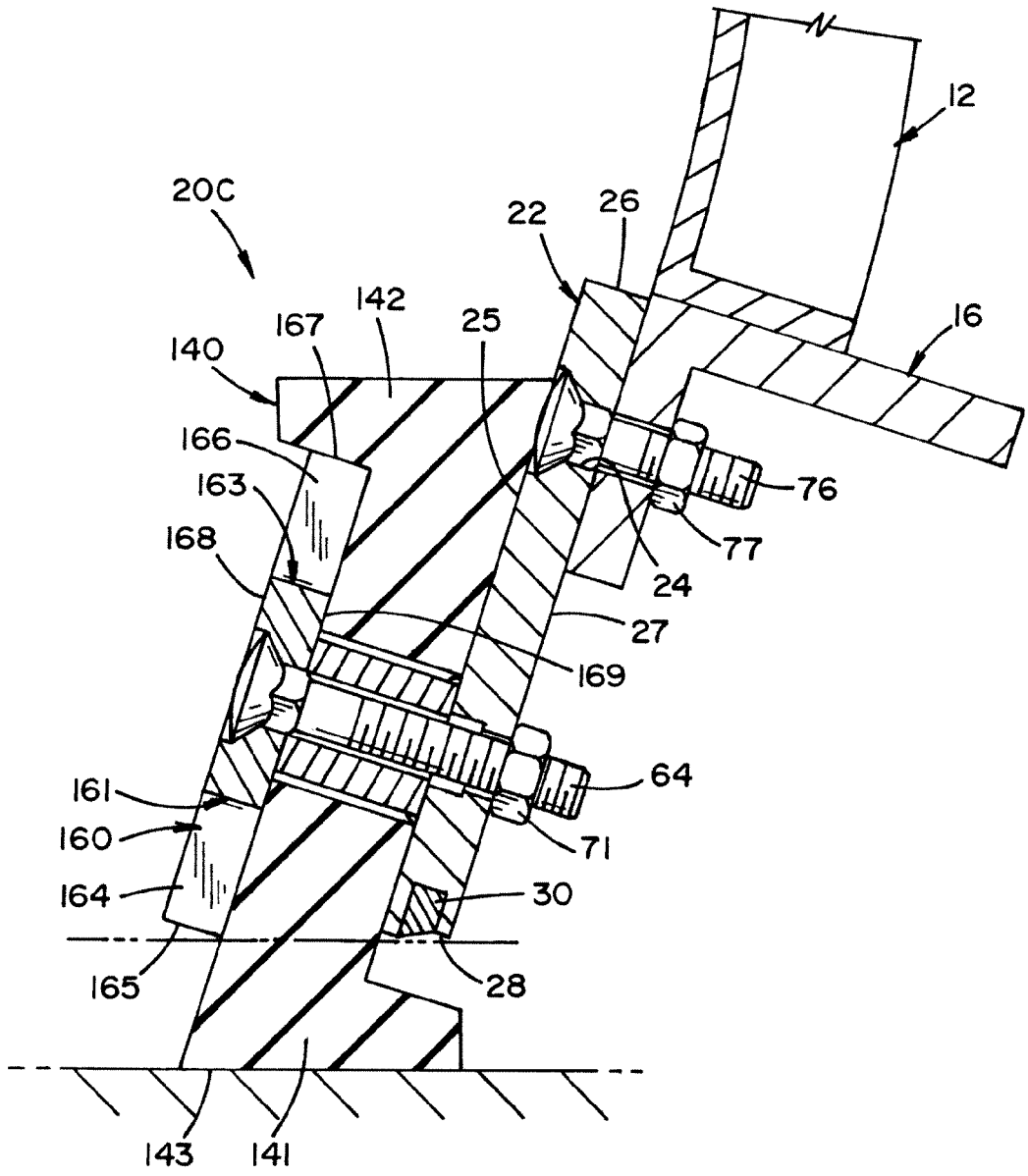
FIG. 10 is a cross sectional view taken along section lines 10-10 in FIG. 9.
Figure 11:
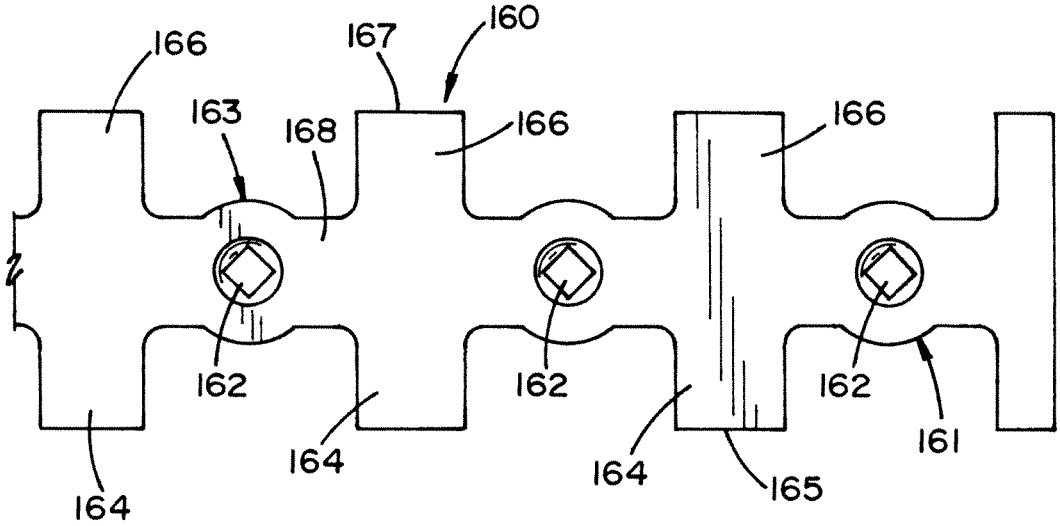
FIG. 11 is a plan view of a scarifier bar.

It is to be appreciated, that in use, elastomeric blade 140, and/or legs 141, 142 will wear to the point that a bottom edge 143 of blade 140 will generally be aligned with a bottom edge 165 of bar 160 and the bottom edge 28 of adaptor blade 22 (in one mounting arrangement). In this manner, edges 165, 143, and 28 will generally be aligned and proximal to, or in contact with, the road or underlying surface. On one side, a lengthwise scarified edge 161 can include an interrupted edge surface including a plurality of teeth 164 having edges 165 proximal to the road or underlying surface. On another opposing side, and in another mounting orientation, a lengthwise scarified edge 163 can include an interrupted edge surface including a plurality of teeth 166 having edges 167 proximal to the road or underlying surface (FIGS. 9-11).

It is to be appreciated that bar 160 can be mounted in four different orientations (not shown). A first orientation includes face 168 facing outward and edge 165 in a downward position. A second orientation includes face 168 facing outward and edge 167 in a downward position. A third orientation includes face 169 facing outward and edge 165 in a downward position. And a fourth orientation includes face 169 facing outward and edge 167 in a downward position. The bar 160 can thus be rotated (i.e. superimposed) lengthwise and rotated widthwise to position each edge 165, 167 in two different directions (orientations) in order to enable even wear and to extend the life of bar 160.

Edge surfaces 165, 167 engaging, or proximal to, the underlying surface represent a minority of the overall length of edge surfaces 161, 163. In one embodiment, the overall edge surfaces 165, 167 comprise less than one-half of the overall length of edge surfaces 161, 163, respectively. In another embodiment, the overall edge surfaces 165, 167 comprise less than one-third of the overall length of edge surfaces 161, 163, respectively. The edges 165, 167 provide a hardened surface for engaging and disturbing hardened material (i.e. packed snow and ice) that are in the path (i.e. upstream) of the moving plow. The aforementioned arrangement provides the benefits of having hardened edges 165, 167 for breaking up material, an elastomeric blade edge 143 for moving fluids and quieting the plow, and a carbide reinforced edge 28 for wear resistance. The combination of edge surfaces 165, 28 sandwiching edge 143 provides the functional advantages of improving the movement of solid and fluid materials in the path of the plow blade while quieting and reducing the impact forces therefrom. Edge surfaces 165, 167, 28 provide hardened edges upstream and downstream from edge 143 thus providing the benefits of durability and wear resistance, while maintaining the benefits of an elastomeric edge.

Figure 12:
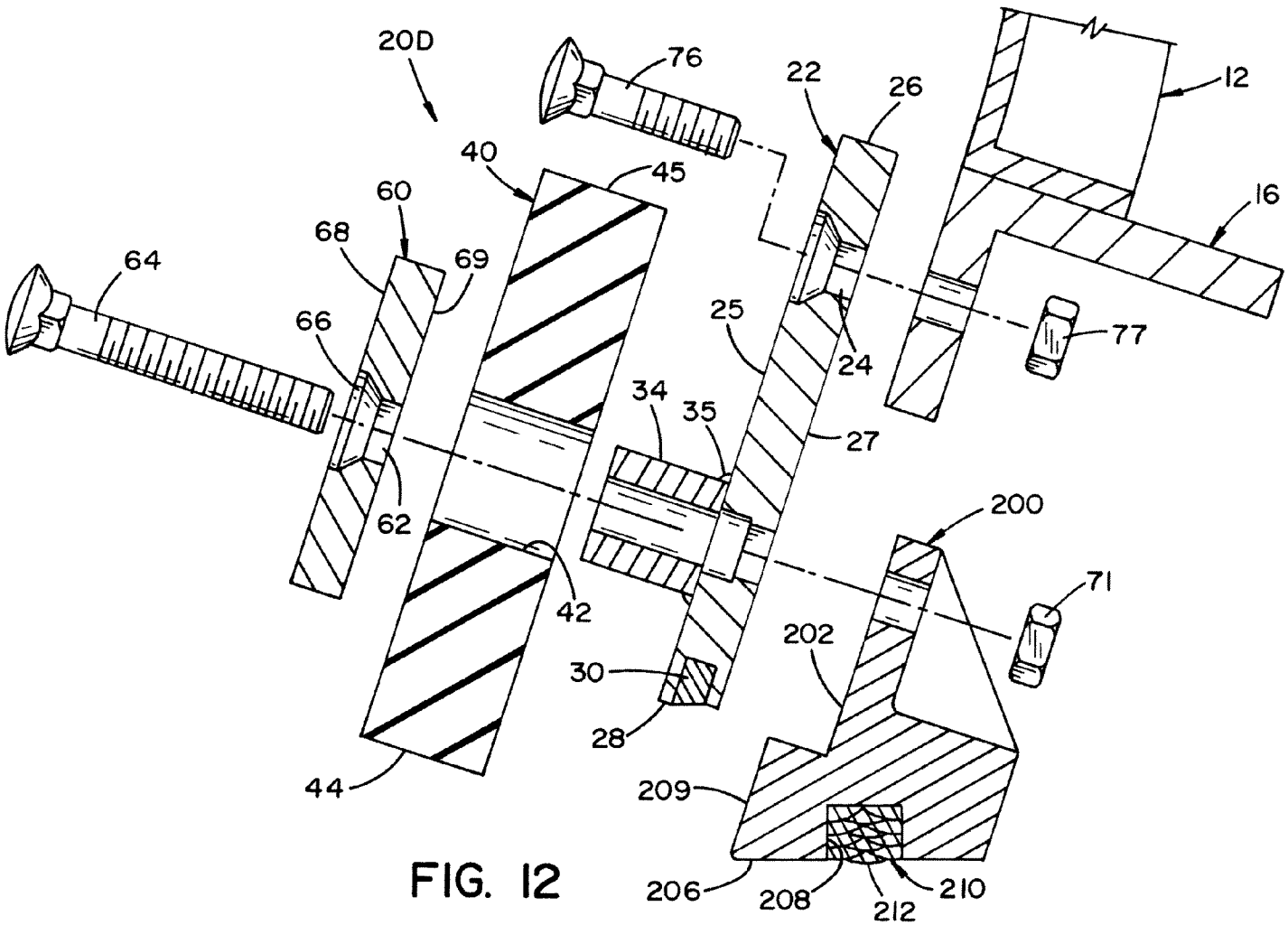
FIG. 12 is an exploded cross sectional view of a plow blade according to a third embodiment of the present disclosure.

Referring to FIG. 12, another embodiment for a plow blade edge kit 20D is therein shown. Mold board or skid shoes 200 can be added to reduce the extensive vibration and the abrasive action between the bottom edges of blades 22, 40 and the road bed over which the snow plow travels. In one mounting arrangement (not shown), a pair of mold board shoes 200 can be mounted on opposing ends of a plow blade or portions of a blade. The skid shoes 200 can include a mounting face 202 which can be secured to the rear side 27 of adapter blade 22 with plow bolt 64 and nut 77. The moldboard shoes 200 can be mounted close to the cutting edges of the snow plow blade system. The mold board shoes 200 can be bolted to the adapter blade 22 such that the adapter blade 22, moldboard shoes 200, elastomeric member 40, and clamp bar 60 can be combined in a plow blade edge system unit wherein individual components can be replaced, added, and/or removed as desired.

The mold board shoes 200 can include generally lateral skid or wear surfaces 206. At least one cavity 208 can be cast into the mold board shoes 200 at the time of casting. The mold board shoes 200 can be cast from steel for greater strength and resiliency. A carbide matrix wear pad 210 can be welded into the cavity 208 to provide improved impact performance, wear resistance, and longer life to the plow blade edge system.

In one mounting arrangement (not shown), the skid shoes 200 can be bolted proximal to opposing ends of the adapter blade 22 (i.e. for a 4 foot length adapter blade). In another mounting arrangement (not shown), a single skid shoe 200 can reside proximal to the center of an adapter blade 22 (i.e. for a 3 foot length adapter blade). The skid shoes 200 reside close to the blade cutting edges and are thus a more integral part of the blade system and therefore, capable of absorbing more of the undesirable abrasive wear and vibration, and capable of providing support to the 'working' edge of elastomeric segment 40. It is to be appreciated that in the mounted position, a front edge 209 of shoe 200 is proximal to a backside of elastomeric blade 40 thereby providing support thereto.

The steel casting of the mold board shoes 200 can take on the following analysis (balance iron).

| C x100 | Mn x100 | P x1000 | S x1000 | Si x100 | Cr x100 | B x100 | Hardness Bhn 363/401 |
|---|---|---|---|---|---|---|---|
| 16 | 140 | 16 | 16 | 525 | 26 | 0.4 | |

Subsequent to casting, the cavities 208 can be filled and/or overfilled by welding therein a layered carbide matrix or weldment 210. The layered carbide matrix 210 can be composed of a series of layered deposits one on top another until the cavity 208 is filled or overfilled. Overfilling the cavity 208 can result in a convex or bulbous layer 212 of carbide matrix 210 terminating beyond, i.e. extending below, the wear surface 206 of the mold board shoes 200. The matrix provides a reconstitutable embedded weldment or resistor for increased wear resistance of the wear surface 206. In one exemplary embodiment, one longitudinal cavity extends along substantially the length of the wear surface 206.

The weldments can comprise a weight of between 0.5 and 2 pounds. The weldments can increase the weight of each shoe 200 from about 2% to about 10%. The weldments can be aligned with the wear surface 206 such that when the plow is in use and traveling along the road surface, the weldments are transverse to the direction of travel. Alternatively, the weldments can be aligned with or canted to, the direction of travel.

The weld deposits 210 can have the following analysis (balance iron):

| C X100 | Cr X100 | Mo X100 | Si X100 | Mn X100 | Hardness/ Rc 55-60 |
|---|---|---|---|---|---|
| 2.60 | 12.00 | 0.62 | 1.37 | .77 | |

Conventional hard-facing or wear-facing weldments can be used for the deposits. So-called chrome carbide steels are the most common, e.g., Stoody Company No. 121, although vanadium carbide (Stoody No. 134) and tungsten carbide ones also can be used very effectively. It is to be appreciated that the weldment material 210 deposited in the cavity 208 has a higher hardness than the steel casting.

The weldment metal 210 must be abrasion-resistant. Generally, it is a high chrome ferrous metal weld. It is reconstitutable in the sense that it can be repaired or replaced by redeposition of carbide matrix by welding.

The wear surface 206 and the embedded or integrated weldments 210 help to support the cutting edges of the blade such that the abrasive action and impact from the roadbed works on the wear surfaces 206 and weldments 210 of the skid or moldboard shoes 200 instead of the other component edges, thereby substantially prolonging the life of the cutting edges. In addition, the weldments 210 substantially prolong the life of the associated shoe 200 due to the wear surface 206 being a combination of carbide matrix and steel casting.

The surface area of the weldments 210 can comprise from about 10% to about 20% of the total surface area of the bottom wear surface 206.

The present disclosure provides an elastomeric, plow blade edge kit 20, 20A, 20B, 20C, 20D for use in a plow on any form of media. The present disclosure may be used for moving dirt, snow, slush, gravel, sand, blacktop, sawdust, manure, and fluids (including water, paint, petroleum-based fluids, food products, among other fluids), among other materials. The plow blade edge according to the present disclosure is more durable and less prone to damage and require less frequent replacement than prior art plow blade edges. The resilient construction of the present disclosure also transmits less load to vehicles, vehicle mounting equipment, and vehicle operators than prior art plow blade edges. In addition, the resilient plow blade edges according to the present disclosure is more effective when plowing non-rigid media, for example, slush and water, compared to rigid metallic prior art plow blade edges. The sandwiched elastomeric blade reduces 'chatter' from the other mated bars and blades mounted thereto in the plow blade edge system, and reduces 'chatter' from the road surface below. Impact forces from the road surface are also dampened with the aforementioned edge system.

While the present disclosure has been particularly shown and described with reference to preferred embodiments, it will be understood by those skilled in the art that various changes in form and details may be made to the present disclosure without departing from the spirit and scope of the present disclosure described in the following claims.

The invention claimed is:

1. A plow blade edge system for mounting to a mold board of a plow comprising:

an adapter blade including a bottom edge having a carbide insert along a portion of said bottom edge;

an elastomeric blade secured selectively in a first position or a second position;

said elastomeric blade selectively reversible about a centerline to present a first edge as an initial bottom edge to a plow surface in said first position and a second edge as an initial top edge in said first position;

a clamp bar wherein said clamp bar is mounted to said adapter blade with said elastomeric blade secured adjacent to and supported between said clamp bar and said adapter blade; and, wherein said elastomeric blade is reversed to present said second edge in said second position to a plow surface after said first edge in said first position is worn.

2. The plow edge as recited in claim 1, wherein said elastomeric blade material is selected from the group consisting of styrene butadiene rubber (SBR), polyurethane, polyethylene, polystyrene, and rubber.

3. The plow edge as recited in claim 1, wherein said clamp bar is reversible from a first mounting arrangement to a second mounting arrangement.

4. The plow edge as recited in claim 3, wherein said first mounting arrangement includes a plow bolt extending through a countersunk hole of one side of said clamp bar.

5. The plow edge as recited in claim 4, wherein said second mounting arrangement includes a carriage bolt extending through a square hole of another side of said clamp bar.

6. The plow edge as recited in claim 1, wherein an overall wear of said elastomeric blade is from about 28% to about 50% after both said first edge and said second edge have worn to their respective wear lines.

7. The plow edge as recited in claim 1, wherein said clamp bar is a scarifier bar.

8. The plow edge as recited in claim 7, wherein said scarifier bar is reversible from a first mounting arrangement to a second mounting arrangement.

9. The plow edge as recited in claim 8, wherein said scarifier bar is rotatable from a third mounting arrangement to a fourth mounting arrangement.

10. The plow edge as recited in claim 1, further comprising a moldboard shoe mounted to a back side of said adapter blade.

11. A method for replacing an existing plow edge with an elastomeric plow edge comprising:

mounting at least one adapter blade to a mold board;

attaching at least one planar elastomeric plow edge segment to the at least one adapter blade;

connecting at least one clamp bar to the at least one adapter blade wherein the at least one planar elastomeric plow edge segment is secured between the at least one adapter blade and the at least one clamp bar in a selected first position; and, disconnecting the at least one clamp bar from the at least one adapter blade;

flipping at least a first elastomeric plow edge segment from the first position to a second position;

the second position includes exposing an unworn edge of the at least first elastomeric plow edge segment; and, reconnecting the at least one clamp bar to the at least one adapter blade.

12. The method as recited in claim 11, further comprising positioning and attaching at least two elastomeric plow edge segments between the at least one adapter blade and the at least one clamp bar.

13. The method as recited in claim 12, wherein a length of each of the at least two elastomeric plow edge segments is selected from the group consisting of substantially 3, 4, 5, and 6 feet.

14. The method as recited in claim 12, wherein the at least two elastomeric plow edge segments are of equal length.

15. The method as recited in claim 12, wherein the at least two elastomeric plow edge segments are of unequal length.

16. The method as recited in claim 12, further comprising positioning and attaching at least three elastomeric plow edge segments between the at least one adapter blade and the at least one clamp bar.

17. The method as recited in claim 11, wherein said clamp bar is a scarifier bar.

18. The method as recited in claim 17, wherein said scarifier bar is reversible from a first mounting arrangement to a second mounting arrangement.

19. The method as recited in claim 18, wherein said scarifier bar is rotatable from a third mounting arrangement to a fourth mounting arrangement.

20. The method as recited in claim 11, further comprising:

connecting at least one moldboard shoe to a back side of said at least one adapter blade wherein said at least one moldboard shoe provides support to said at least one adapter blade and to said at least one planar elastomeric plow edge segment.

21. A plow blade edge kit for mounting to a mold board of a plow comprising:

an adapter blade including mounting holes for mounting to a mold board;

the adapter blade further includes mounting bushings;

an elastomeric plow blade having a height including holes for placing on the mounting bushings selectively in a first position and a second position;

a clamp bar having holes aligned with the mounting bushings;

a plurality of fasteners passing through the mounting bushings for securing the clamp bar to the adapter blade whereby the elastomeric plow blade is mounted between the clamp bar and the adapter blade;

wherein the clamp bar extends along a front side of the elastomeric blade and supports a majority of the height of the elastomeric blade;

wherein the adapter blade extends along a rear side of the elastomeric blade and supports a majority of the height of the elastomeric blade; and, wherein the elastomeric plow blade in a first position defines a first wear edge positioned partially under said adaptor blade and having a first resilient bottom surface in contact with the road surface.

22. The plow blade edge kit as defined in claim 21, wherein said elastomeric blade material is selected from the group consisting of styrene butadiene rubber (SBR), polyurethane, polyethylene, polystyrene, and rubber.

23. The plow blade edge kit as defined in claim 21, wherein the elastomeric plow blade in a second position defines a second wear edge positioned partially under said adaptor blade and having a second resilient surface in contact with the road surface.

24. The plow blade edge kit as defined in claim 23, wherein an overall wear of said elastomeric plow blade is from about 28% to about 50% after both said first wear edge and said second wear edge have worn to their respective wear lines.

25. The plow blade edge kit as defined in claim 21, wherein said clamp bar is a scarifier bar.

26. The plow blade edge kit as defined in claim 25, wherein said scarifier bar is reversible from a first mounting arrangement to a second mounting arrangement.

27. The plow blade edge kit as defined in claim 26, wherein said scarifier bar is rotatable from a third mounting arrangement to a fourth mounting arrangement.

28. The plow blade edge kit as defined in claim 25, wherein the adapter blade includes a bottom edge including carbide inserts adjacent along at least a portion of the bottom edge.

29. The plow blade edge kit as defined in claim 21, further comprising a moldboard shoe mounted to a back side of said adapter blade.

30. The plow blade edge kit as defined in claim 29, wherein said moldboard shoe includes a reconstitutable carbide matrix welded into a cavity along a wear surface of said moldboard shoe.

* * * * *